United States Patent [19]

Wallace

[11] Patent Number: 4,865,490

[45] Date of Patent: Sep. 12, 1989

[54] PORTABLE WELLHEAD AND WELDER PROTECTOR SYSTEM

[76] Inventor: Henry Wallace, 58 Mason St., Gretna, La. 70053

[21] Appl. No.: 241,965

[22] Filed: Sep. 8, 1988

[51] Int. Cl.[4] ..... E02B 17/02; E21B 7/12

[52] U.S. Cl. ..... 405/303; 166/356; 405/195; 405/211

[58] Field of Search ..... 405/211, 195, 188, 190, 405/303; 166/356, 75.1, 368, 67, 360; 175/86, 219

[56] References Cited

U.S. PATENT DOCUMENTS

| | | | |
|---|---|---|---|
| 1,834,655 | 12/1931 | Shaw . | |
| 2,196,704 | 11/1938 | Markle . | |
| 2,235,274 | 11/1943 | Hampton . | |
| 2,528,721 | 11/1950 | Brockman et al. . | |
| 2,804,951 | 9/1957 | Kolt . | |
| 3,198,285 | 8/1965 | Nerlich . | |
| 3,328,970 | 7/1967 | Giambelluca | 405/188 |
| 3,452,764 | 7/1969 | Bell . | |
| 3,466,880 | 9/1969 | Elliott | 405/190 |
| 3,508,410 | 4/1970 | Lynch | 405/190 |
| 3,512,583 | 5/1970 | James | 166/356 |
| 3,525,290 | 8/1970 | Pelsue | 404/25 X |
| 3,529,427 | 9/1970 | Titman . | |
| 3,602,301 | 8/1971 | James | 166/356 X |
| 3,661,204 | 5/1972 | Blanding et al. | 166/356 |
| 3,783,906 | 1/1974 | Matherne . | |
| 3,864,924 | 2/1975 | Piotin | 405/188 |
| 3,964,543 | 6/1976 | Rodgers | 166/358 |
| 4,273,472 | 6/1981 | Piazza et al. | 166/356 X |

*Primary Examiner*—Dennis L. Taylor

*Attorney, Agent, or Firm*—C. Emmett Pugh

[57] ABSTRACT

A wellhead and welder protector comprising an easily erected, temporary shelter designed to envelope a wellhead and the immediate surrounding area of either a production platform, well bay area or jack up rig "texas deck", for providing an optimal environment for welding, heat treatment, and similar processes. The overhead protection means can be in the form of a horizontal, planer surface comprised of aluminum, galvanized sheet metal, thick fabric or the like, supported via telescopic support means above the wellhead for providing overhead protection for its occupants from overhead falling objects and liquids. Self contained ventilation means for the removal of any toxic fumes and gases associated with welding and related processes is also included. Additionally a new and unique framing system associated with the protection means is used, comprising telescoping support members attached directly to the wellhead to provide ample room in the shelter; the configuration and design of the shelter is such that it is able to withstand the harsh weather such as tropical storms and the like, associated with the offshore drilling environment, yet is lightweight, sturdy, and easily assembled and disassembled.

24 Claims, 4 Drawing Sheets

PORTABLE WELLHEAD AND WELDER PROTECTOR SYSTEM

BACKGROUND OF INVENTION

1. Field of Invention

The present invention relates to portable structures and more particularly to a an easily erected, temporary shelter designed to envelope a wellhead and the immediate surrounding area for protecting workers, the wellhead and the well from the elements such as thunderstorms, tropical storms, extreme cold and the like, and providing an optimal environment for welding, heat treatment and other processes.

The present invention also discloses a new and unique means of overhead protection for its occupants as well as self contained ventilation means for the removal of any toxic fumes or vapors associated with welding and related processes.

The present invention further teaches a new and unique framing system comprising telescoping support members attached directly to the wellhead to provide ample room in the shelter; the configuration and design of the shelter is such that it is able to withstand the harsh weather associated with the offshore drilling environment, yet is lightweight, sturdy and easily assembled and disassembled. Alternative means of support are also disclosed.

While the present invention is taught as being used primarily with wellheads, it is noted that this invention may be used in an unlimited variety of configurations and applications, including but not limited to construction relating to buildings, bridges and other large structures and the fabrication of offshore support structures, process piping, production platforms, and the like.

2. Prior Art & General Background

Oil and gas drilling, both on-shore and offshore, has traditionally been a difficult and expensive undertaking. Merely reaching the oil, gas or other resource, many thousands of feet in the ground, is acknowledged as a tremendous feat of engineering. But sometimes equally difficult is coping with the often severe weather associated with the immediate drilling environment on the well bay area of the platform drilling rig, or in the case of a jack-up rig, the "texas deck," during drilling operations and wellhead installations.

It appears that much of the oil, gas and other minerals to be found happen to be in some of the lesser hospitable environments: the arctic, the desert, offshore and the like. High winds, tropical storms, low temperatures, and moisture in some form or another is excessively prominent in many of these areas. The offshore is particularly inhospitable to drilling operations, where tropical storms, gale force winds and very low temperatures are common, as is heavy moisture in the form of rain, snow, hail, sea breeze, etc.

One particular operation in oil field drilling which is particularly vulnerable to harsh and severe weather conditions is the pre- and post-heat treatment of the wellhead, casing and conductor pipe prior to, during, and upon completion of the welding of the wellhead and casing.

During welding operations, the wellhead and casing must be pre-heated some 250 to 1,150 plus degrees fahrenheit in order to provide for a uniform preheated welding surface to insure a high quality weld. High winds, rain, and intense cold tend to greatly hamper the heating and welding processes to a point of making it impossible much of the time, as the heat is dissipated as fast as it is produced.

In addition, the wellhead and casing must be kept free from winds, rain and moisture during the pre-heating and welding process, as the variations in temperature associated with the rain and/or shifting winds coming into contact with the heat affected zones of the wellhead and casing or otherwise undesirable welds such as crooked welds, leaking welds and the like.

Heretofore, the oil and gas industry has not provided a shelter specifically designed to facilitate an optimal environment during tropical storms and the like for the pre-heating and welding of the wellhead, casing and conductor pipe on the well bay floor of a production platform or the "texas deck" of a jack up rig. In the past, many of the problems associated with providing wellhead shelters in order to increase worker productivity and efficiency in the preheating and welding processes during hostile weather such as thunderstorms, tropical storms and the like were due to the nature of the preheating and welding process itself, which could generate life threatening, toxic fumes and vapors. Closed shelters were thus not advantageous, as the fumes and vapors would not be dissipated adequately, endangering any worker in the shelter.

Further, the hostile weather conditions themselves would make erecting the structure difficult; this is especially true for one designed to withstand high winds and heavy rains, thereby normally requiring heavy and cumbersome support structures. Further, heretofore the industry has failed to design a portable structure which would adequately shelter the worker, the wellhead and the well, while providing an environment having space conducive to the preheating and welding process during inclement weather conditions.

At present, with no structure to shelter the wellhead and welder from any and all adverse elements during heating and welding, there is no other alternative but to shut the rig down at a cost of many tens of thousands of dollars for every hour, while waiting for weather conditions to improve. The present invention enables the rig to successfully preheat and weld the wellhead non-stop during thunderstorms, tropical storms, and the like, or in any environment or harsh weather condition, thus saving the rig thousands of dollars of lost rig time and loss of production.

The prior art does appear to anticipate basic tent-like shelter structures for protection of horizontal, below ground transport pipeline welders and the like, but does not anticipate the present invention in its preferred form, which provides a new and unique device and method for sheltering a wellhead and its occupants during heating and welding in inclement weather (tropical storms, etc.) and teaching active ventilation means, overhead protection, heavy duty, sturdy but light weight construction, and easily assembled and disassembled.

A list of prior patents which may be of interest are cited below:

| Patent No. | Patentee(s) | Issue Date |
|---|---|---|
| 1,834,655 | C. E. Shaw | 12/01/1931 |
| 2,196,704 | W. C. Markle | 11/03/1938 |
| 2,235,274 | Hampton | 11/30/1943 |
| 2,528,721 | Brockman et al | 11/07/1950 |
| 2,804,951 | Kolt | 09/03/1957 |
| 3,198,285 | Nerlich | 08/03/1965 |

-continued

| Patent No. | Patentee(s) | Issue Date |
|---|---|---|
| 3,452,764 | Bell | 07/01/1969 |
| 3,529,427 | Titman | 09/22/1970 |
| 3,783,906 | Matherne | 01/08/1974 |

U.S. Pat. No. 2,196,704 entitled "Windbreak for Oil Derricks" teaches a single wall canvas windbreak to be incorporated into the top platform structure of an oil derrick to protect any workers on the top platform from exposure. This shelter comprises essentially a wind screen designed to prevent its occupants from being blown off the upper deck and is clearly distinguishable from the present invention.

U.S. Pat. No. 3,783,906 entitled "Apparatus for Welding Vertical Members during Inclimate Weather" teaches an umbrella-like canopy, which may be mounted around the periphery of stacked drive pipe or conductor pipe, to prevent rain from falling upon the pipe during welding.

It is noted that this patent only teaches an umbrella-like "roof" structure of canvas and not "walls", and apparently is more of a sun and very light rain shelter. The patent apparently does not contemplate utilization of the structure during tropical storms and the like, which includes driving rain or high winds, as the design of the patent would not adequately protect the pipe and the welder from the rain blown under the structure by the wind.

Further, utilization of the patent in high winds would apparently cause the structure to reverse, much as an umbrella would when the wind catches it from underneath. In addition, the structure does not contemplate overhead protection means, as the fabric would certainly not provide adequate protection for overhead falling objects or corrosive liquids.

Additionally, it is apparent that the above patent does not contemplate a light weight but heavy duty easily fabricated structure for providing a totally controlled environment, insulated from the outside environment for more efficient, controlled preheating with active ventilation means and overhead protection like the present invention.

U.S. Pat. No. 3,452,764 entitled "Pipeline Welder's Tent" teaches a tent structure adapted to providing a working environment for welders fabricating or repairing horizontal, underground transport pipelines. The patent teaches the incorporation of passage holes in the side walls for pipeline, and the tent-like structure is to provide an "enclosure of the workman himself within an environment which could enhance his working effectiveness".

Like the other prior art, this patent is clearly distinguishable from the present invention. The above patent is merely a standard tent design adapted to receive pipe through its walls to protect the welders from the elements. This patent does not protect the welder and the weld from excessive driving rains from overhead and on the side passage holes of the test while welding, and this patent fails to incorporate adequate protection from pouring rains which might fall through the tent, as well as failing to provide adequate ventilation means and this failure could result in worker exposure to excessive toxic fumes, thereby causing injury and perhaps even death.

Thus, based upon the above and foregoing, one can ascertain that there clearly exists a need for a portable, easily erected wellhead protective shelter, which would allow for more efficient heating and welding of wellheads and casing on the well deck of the production platform below the drilling rig and the "texas deck" of a jack up rig which would provide means of maintaining a desirable temperature therein while allowing active ventilation of toxic fumes and vapors under virtually all weather conditions, and provide overhead protection as well.

3. General, Summary Discussion of the Invention

The present invention overcomes these prior art problems by providing a portable, on site wellhead and welder protection system, which is highly reliable, relatively economical and very cost effective.

The preferred embodiment of the present invention provides a structure which is comprised essentially of three components the overhead shelter/ventilation means, side walls, and adjustable support means. These component parts are designed to provide a heavy duty, sturdy but easily fabricated shelter in a manner which allows for the device to be relatively light in weight and transportable in a single, relatively compact storage case.

The preferred embodiment of the present invention teaches a unique, adjustable support means affixed directly to the wellhead of the drilling apparatus. This embodiment is designed to be used for wellhead heating and/or welding while on the well bay deck of the drilling rig or platform, protecting the worker from the outside environment, whether it be tropical storms, excessive cold, rain, winds, or overhead falling objects and liquids from the rig itself.

An alternative embodiment of the present invention contemplates a similar overall design as the preferred embodiment, but having support means for use in conjunction with the "texas deck", a somewhat unstable deck utilized in conjunction with jack-up drilling rigs, generally supported in mid-air by cables under the rig itself. This deck generally has a grating floor suspending a significant height above the water, having an opening in the center which allows for the drive or conductor pipe and wellhead to pass into the drill bore.

A problem associated with working on the texas deck relates to the instability and danger associated with the design of the deck itself. As mentioned above, the deck is generally suspended by support cables from the upper deck of the drilling rig. High winds and rain causing the texas deck and the conductor or drive pipe which is supporting the wellhead to rock to and fro, providing a base which is not only almost impossible to work on, but also highly dangerous.

Adding to the danger of this situation is the fact that the texas deck and conductor or drive pipe tend to rock in opposite directions or rhythms, the texas deck influenced by the wind and the drive or conductor pipe influenced by rough seas. The high winds and rough seas in combination thus cause the texas deck and conductor pipe to oscillate at two separate frequencies clashing at their union on the texas deck.

The alternative design of the present invention for use in conjunction with a texas deck incorporates means to stabilize the immediate environment of the wellhead and welder protector in the form of a portably attached floor area directly connected to the wellhead and base plate of the wellhead, suspending the wellhead and welder protection device with its own floor above the texas deck, thereby freeing the welder from the rocking texas deck and wellhead, and providing an environment totally isolated from all inclement weather, with means of ventilating toxic fumes and over head protection means.

The preferred embodiment of the present invention contemplates an overhead support structure of aluminum or other light weight material, sectioned in two parts for transportation purposes, but which is easily joined to form one sturdy, somewhat planar surface. The over head protection structure is designed to prevent overhead falling objects from hitting, injuring or killing the workers. The overhead protection structure is also designed to prevent water and other liquids from flowing or otherwise falling into the environment of the wellhead, and thus incorporates a gasket between the joined halves in order to provide a liquid resistant seal.

The telescoping support members are threadingly attached to the overhead support structure and are able to be affixed in a variety of configurations to fit the different configuration and size wellheads used via adjustable mounting means incorporated into the overhead support.

The overhead support structure also includes active ventilation means for ventilating excess heat and/or toxic fumes which form during welding operations. The ventilation mean in the preferred embodiment is in the form of a thermostatically controlled electric turbine mounted on the overhead support structure of the present system. Other devices for ventilation, including but not limited to wind driven turbines and the like, may be used; the choice of turbine and/or other types of non-movement ventilators is dependent upon the climate and needs associated with the particular operations involved.

The sidewall of the present invention is fabricated of a heavy duty, water and fireproof fabric, and includes means for easy attachment to the overhead support, adjustable ventilation ports, vinyl windows, passage means, and means for attachment to the well deck, or, in the form of a texas deck, means for attachment around the base of the wellhead and casing.

The sidewall is specifically designed to be windproof and have thermal insulating characteristics in order to increase the efficiency of pre- and post-heating operations of the wellhead and casing or conductor pipe and provide for an optimal environment for welding and other operations associated with but not limited to the fabrication, maintenance, and support of the well and wellhead.

The present invention is designed to be transported with the welding team to the site, erected and utilized, taken down and repacked for another use elsewhere. The present structure is thus configured to provide for a wellhead and welder protection, which includes maximum ease of fabrication, with all parts secured and adjusted in a manner which provides for maximum time savings yet produces a highly stable structure.

The structure, once erected, provides a controlled environment which provides for much more efficient heating of the wellhead and casing in adverse weather, such as tropical storms and the like, and allows for welding under weather conditions such as thunderstorms, tropical storms, etc., which would normally prohibit such activities.

It is thus an object of the present invention to provide a wellhead and welder protector which includes active ventilation means and overhead protection means.

It is also an object of the present invention to provide a wellhead and welder protector which is relatively light in weight, easily transportable and quickly erected, yet heavy duty and able to withstand harsh weather such as thunderstorms, tropical storms and the like.

It is a further object of the present invention to provide a wellhead and welder protector which is directly attached to the wellhead, in an adjustable manner so as to provide maximum efficiency with regard to the amount of sheltered area.

It is a still further object of the present invention to provide for a wellhead and welder protector having active ventilation means designed specifically for ventilating toxic fumes associated with welding processes and the like.

It is another object of the present invention to provide a wellhead and welder protector having means to provide a stable working environment for use in conjunction with but not limited to wellheads on a texas deck.

It is still another object of the present invention to provide a wellhead and welder protector having means of providing a controlled environment specifically tailored for the increased efficiency of pre- and post-heating operations with regard to the preparations of the wellhead, casing and/or conductor pipe of the well.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED, EXEMPLARY EMBODIMENTS

Figure 1:
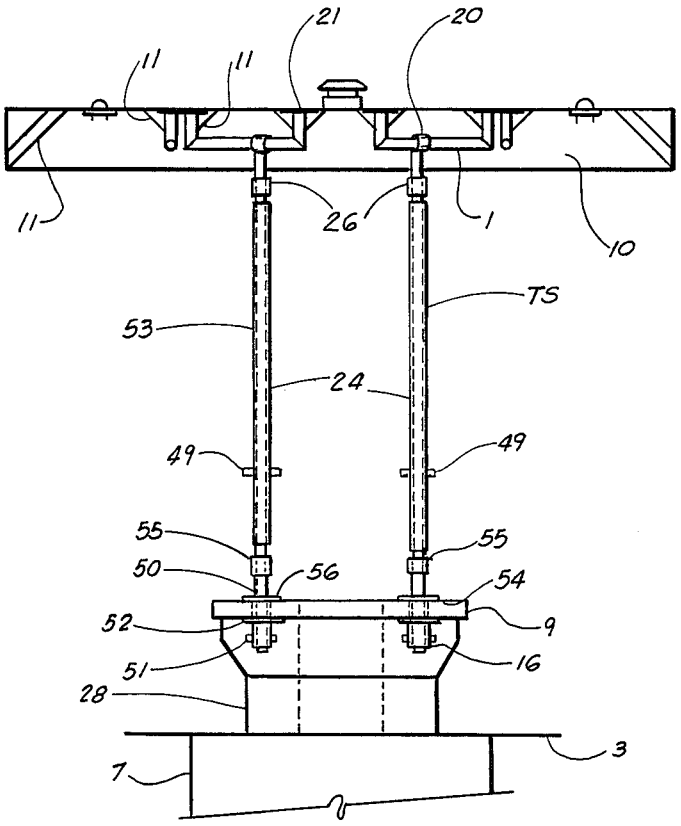
FIG. 1 is a side, partially cross-sectional view of the preferred embodiment of the wellhead and welder protector system of the present invention, illustrating the overhead protector and its engagement to the telescoping support means, with the embodiments attachment to the wellhead with the side walls not included.

As may be ascertained by a viewing of FIG. 1, the wellhead and welder protector of the preferred, exemplary embodiment of the present invention includes telescoping support means TS having telescoping piping 24, 53 of steel or the like, the outer piping 24 being for example approximately one inch in diameter, and the inner piping 53 being for example approximately five eighths of an inch in diameter.

The telescoping piping 24, 53 includes means of height adjustment in the form of a plurality of vertically descending adjustment holes of predetermined distance in which bolt 59 may be placed for retaining the support means TS at the desired height.

The support means TS also includes means to adapt to various size flange type wellhead assemblies 9 utilizing sliding means in the form of an adjustable wellhead sleeve guide 1. The telescoping support means 24, 53 is attached to the sleeve guide 1 via slide sleeve 20. Sleeve 20 has a diameter slightly more than sleeve guide 1 to allow it to slide into the desired position, yet is sized so as facilitate a tight fit. Sleeve 20 includes means to threadingly engage union 26 for attachment to the inner telescoping support pipe 53.

Outer telescoping support pipe 24 is threadingly engaged to lower union 55. Lower union 55 is identical in configuration to upper union 26; that is, the unions are configured to have two sets of threads, one for the upper connection and the other for the lower connecting member, with the threads being opposite in direction in order to facilitate simultaneous connection of both connecting members Lower union 55 threadingly connects flange connection assembly 50 to the telescoping support member 24. Flange connection assembly 50 includes means to fit a variety of different size holes in the form of a large washer assembly 56 weldingly attached near the lower union 55 to prevent the assembly 50 from passing through a tap hole 54, which may be large in diameter than union 55.

Connection assembly 50 passes through the flange tap hole 54 and is threadingly connected under the hole 54 by locking device 16. Locking device 16 is threaded so as to facilitate quick engagement and locking of connection assembly 50 in place. Locking device 16 further incorporates locking nut 51, to prevent the device from inadvertently coming unattached, and washer 52 to allow the device 16 to be used with tap holes 54 of larger diameter than the device 16.

Figure 2:
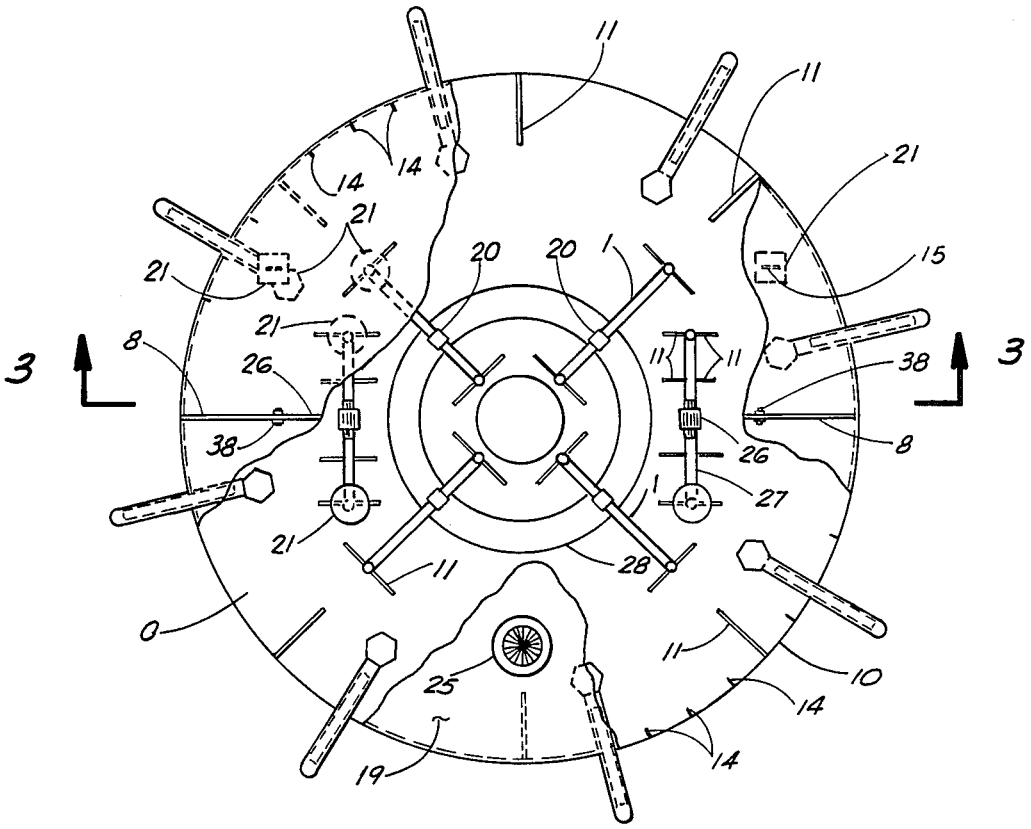
FIG. 2 is a top, partially cut away view of the preferred embodiment of the wellhead and welder protector system, illustrating the overhead protector and the various hardware associated therewith.
Figure 3:
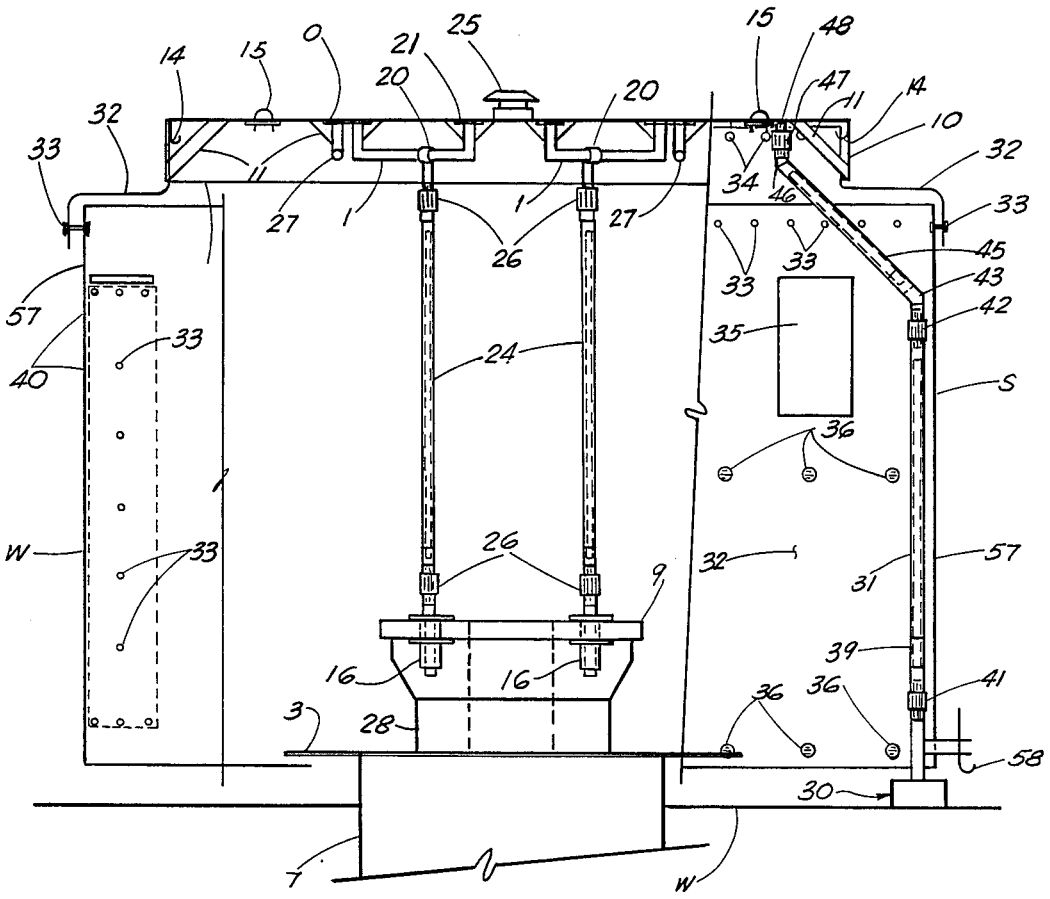
FIG. 3 is a side, partially cross-sectional view of the preferred embodiment of the wellhead and welder protector system of the present invention, illustrating the placement and construction of the side wall and supports.

As may be ascertained by a viewing of FIGS. 2 and 3, the exemplary wellhead and welder protector system of the present invention further includes overhead protector O threadingly attached to telescopic support means TS. The preferred embodiment of the present invention teaches overhead protector O as having a circular configuration, but it is noted that the protector O could have varying configurations, depending upon the specific application.

The overhead protector O may be composed of galvanized sheet metal, aluminum or any strong but light substance, such as thick fabric. The exemplary embodiment is composed of aluminum in order to provide a light, easily transportable device which has sufficient strength to reasonably withstand impacts from overhead falling objects.

The overhead protector O includes a protector cover plate 19 completely covering over the top of the desired area to be protected and designed to shield its occupants, the wellhead and the well from adverse weather conditions and overhead falling objects, as well as providing a base for the ventilation means 25 for preventing excess build-up of toxic fumes and the like.

The overhead protector O is designed to be transported in two equal pieces, joined at flange and gasket assembly 8. The two pieces are joined incorporating a gasket of neoprene or the like in order to keep liquids such as drilling fluids, water, rain, etc., from penetrating the shelter.

The two halves are joined into one piece via union assemblies 27, a connection of pipe or the like weldingly attached to protector cover plate 19. Union assembly 27 includes means to threadingly attach the two pieces of the protector O utilizing union 26. Union assembly 27 is configured so as to space union 26 approximately one inch below protector cover plate 19, so as to pass beneath flange and gasket assembly 8. Gussets 11 are weldingly attached from the protector cover plate 19 to the union assembly 27 for reenforcement.

In addition to the union assembly 27, the present invention utilizes flange bolts 38 of stainless steel or the like to further strengthen the union. The bolts 38 join the two pieces via holes in the flange and gasket assembly 8, and are spaced at predesignated intervals, the exemplary embodiment having, for example, the bolts 38 every other inch.

Weldingly attached to the outer periphery edges of protector cover plate 19 is stabilizer 10. In the exemplary embodiment of the present invention, stabilizer 10 provides an approximate four inch overhang along the edge of the overhead protector O, stabilizing the system and providing a means of attachment of the upper sidewall 32 via "J" hooks 14 weldingly attached to the interior of stabilizer 10 and various hooks and eyelets 34 at predesignated intervals. Gussets 11 strengthen the attachment of stabilizer 10 to cover plate 19.

In order to facilitate lifting of the overhead protector O for fabrication and disassembly, lifting "U" bolts 15 are provided through the cover plate 19, with stop means provided on the underside of the plate 19. Stiffener plates 21 are provided between the "U" bolts 15 and the underside of the cover plate 19 in order to increase lifting capacity of the bolts 15 and to prevent overhead protector O from sagging.

Ventilator 25 is threadingly attached via nut and bolt combinations or other method to the upper portion of the overhead protector O. The exemplary embodiment of the present invention utilizes a thermostatically controlled electronic ventilator manufactured by Clark United, Model RV17GR. The ventilator may be placed in a variety of areas on the roof, sidewalls and the like of the overhead protector O, the exemplary embodiment having placement on one side of the overhead protector O approximately one foot from the edge and apart from the flange and gasket assembly 8.

As is illustrated in FIG. 3, the present invention also includes side wall means S in the form of a heavy duty fireproof/waterproof material in conjunction with support and stabilizing means. The exemplary embodiment utilizes Zetex of, for example, 0.125 inch thickness and may incorporate an outer windbreaker tarpaulin sewn thereto as an optional feature, if so desired.

The sidewall S is supported via support attachment member 48, a threaded member weldingly attached to the interior of cover plate 19. Member 48 is threadingly attached to upper wall support member 45 via union 47. Upper wall support member 45 incorporates approximate forty-five (45) degree angles outward at points 46 and 43 in order to facilitate the most efficient space utilization of the wellhead and welder shelter W and is telescopic with means for adjusting length for configuring the walls to a variety of desired sizes. Lower wall 57 is attached to upper wall 32 via snaps 33.

Upper wall support member 45 is threadingly attached to lower wall support member 31 via union 42. Lower wall support member 31 is telescopic and has means of maintaining the adjusted height via a series of adjustment holes at predetermined intervals. Adjustment bolts 39 of stainless steel or the like are implemented for adjusting support member 31 adjustment holes 39. Lower wall 57 is attached to lower support member 57 via a sleeve incorporated into the interior of lower wall 57.

Magnetic base 30 is threadingly attached to lower support member 31 via union 41 and includes a magnet on the lower part of base 30 for attaching the support firmly to the floor of the well bay area. In the case of a grating floor, the magnetic base 30 also includes hook means of connection in the form of an adjustable "J" hook for firm connection in high winds and the like.

In addition to providing fireproof protection from the elements, lower side wall 57 includes ventilation means 36 located in predetermined horizontal intervals on the lower and middle areas of the side wall 57. The ventilation means 36 is sized and spaced for providing maximum efficiency of ventilation by working in conjunction with ventilator 25. The exemplary embodiment of the present invention teaches the utilization of two inch midget round vents as distributed by Clark manufacturing. It is noted that ventilation means 36 may be adjustable or fixed, depending upon the contemplated application and environment.

Lower side wall 57 also includes window means 35 of clear vinyl or the like, such as that manufactured by Thermwell Products Co, Inc., having a thickness of, for example, ten gauge or the like. The exemplary embodiment incorporates windows measuring approximately one foot wide by two feet tall, and spaced at approximate three foot intervals.

Flap door 40 is provided in the side of lower side wall 57 for passage of the workers in and out of the shelter. The flap door 40 utilizes snaps 33 for securing the overlapping flap door 40 closed.

A further alternative embodiment of the present invention relates to the utilization of the wellhead protector W in conjunction with the texas deck of a jack-up rig or the like.

Figure 4:
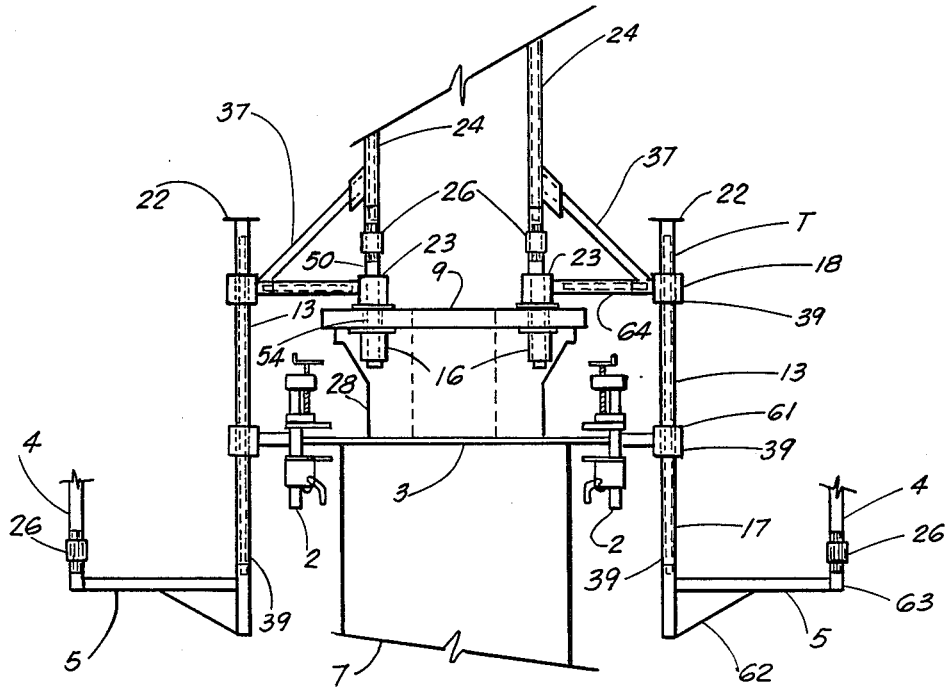
FIG. 4 is a side, partial view of an alternative embodiment of the wellhead and welder protector system of the present invention, designed to be used in conjunction with the texas deck of jack up rigs, illustrating the means of stabilizing and support associated with this alternative embodiment.

FIG. 4 illustrates mounting means for the present invention adapted to be used in conjunction with the texas deck, including means for providing a working surface independent of the texas deck. The alternative embodiment as illustrated in FIG. 4 provides a working environment totally isolated from the rocking texas deck, thereby providing a safer, more stable environment for the heating and/or welding of the wellhead and casing or drive pipe.

For flange-type wellheads on Texas decks, the Texas deck embodiment T teaches a means of attaching the support means TS of the wellhead protector W similar to the principle embodiment disclosed in FIG. 1, that is, the utilization of a flange connection assembly 50 which passes through flange tap hole 54 and secured by locking device 60.

Emanating at an approximate forty-five (45) degree angle from lower outer support member 24 is a telescopic pipe brace 37. Swivel 23 is slidably placed over flange connection assembly 50 to provide a means of attachment of telescopic pipe brace 64, which extends from assembly 50 at a perpendicular, horizontal position, intersecting with pipe brace 37 at pipe guide 18. Pipe braces 37, 64 together provide sufficient stabilization of the Texas deck embodiment T to provide floor support means 5 disclosed below.

Pipe guide 18 includes telescoping piping adjustment bolts 39 of stainless steel or the like to adjust the position of telescopic vertical board support member 13, 17 which passes through pipe guide 18. Stop plate 22 is weldingly attached to the top of vertical board support member 13 to provide a safety stop in the event piping adjustment bolts 39 fail.

In order to further reinforce the vertical board support member 13, 17, the present device utilizes base plate clamp 2 for providing a friction connection to the base plate 3 of wellhead 28. The exemplary embodiment of the present invention utilizes a base plate clamp 2 manufactured by Ohio Forge, model 643-793. Projecting horizontally from base plate clamp 2 is pipe guide 61 and more piping adjustment bolts 39.

Projecting away from conductor pipe 7 horizontally from lower vertical board support member 17 is board support 5. Board support 5 provides a platform for placement of boards for utilization by the welder as a floor independent and away from the Texas deck. Board support 5 is further stabilized by gussets 62 angled from lower vertical board support member 17.

Weldingly attached in a vertical manner to the end of board support member 5 farthest from conductor pipe 7 is outer wall attachment member 63, providing means to threadingly attach the Texas deck embodiment 63 to telescopic wall support 26 via union 26.

Figure 5:
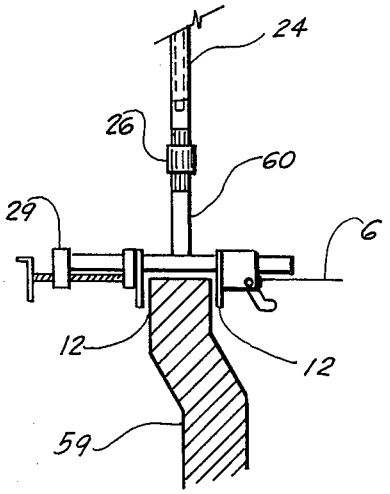
FIG. 5 is a side, partial, cross-sectional view of a further alternative embodiment of the present invention, illustrating an alternative means of attaching the support means of the present invention to the wellhead utilizing clamping means in lieu of the preferred method.

FIG. 5 illustrates an alternative embodiment of the present invention designed for non-flange type wellheads and those which do not have tap holes 9 or similar means for mounting the support means S. In lieu of flange connection assembly 50, the alternative embodiment contemplates the utilization of wellhead clamp 29 threadingly affixed to the wellhead 59 via threadingly applied friction fit. The exemplary embodiment of the present invention utilizes a wellhead clamp 29 manufactured by Ohio Forge, model 643-743.

In use, wellhead clamp 29 is merely placed upon the appropriate portion of wellhead 59 and tightened sufficiently to provide a stable base for support means S. Wellhead clamp 29 includes a connection surface 12 of heat resistant neoprene, the neoprene utilized in the exemplary embodiment manufactured by Boston Industrial Products, Style 250.

Extending perpendicularly and in a vertical fashion from wellhead clamp 29 is support connector member 60. Support connector member 29 is threadingly affixed to lower support member 24, thereby completing the alternative means of support.

Figure 6:
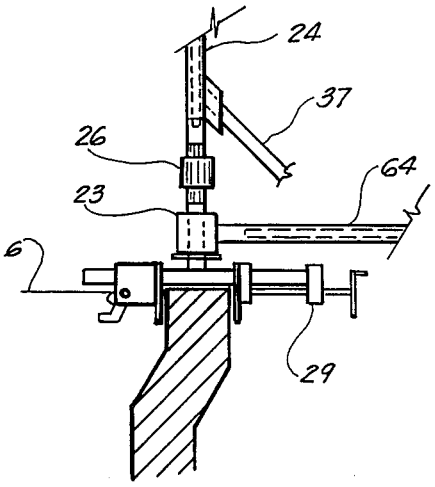
FIG. 6 is a side, partial, cross-sectional view of a similar alternative embodiment as illustrated in FIG. 5, but for use in conjunction with the alternative embodiment designed for us in conjunction with but not limited to the texas deck.

FIG. 6 illustrates still another alternative embodiment of the device disclosed in FIG. 5 for utilization in conjunction with texas decks not having flange wellheads. The device is identical to the device contemplated in FIG. 5 above, except for the additional incorporation of telescopic pipe brace 37 emanating at an approximate forty-five (45) degree angle relative to lower support member 24, and horizontal telescopic support piping 64, connected to vertical support member 24 via swivel 23. This means of connection is contemplated to be used in conjunction with the texas deck embodiment T contemplated in FIG. 4 above.

Other alternatives in the present invention relate to alternative means of support of the overhead support means 0 of the present invention.

One alternative means of support relates to the utilization of overhead support cables, wire rope slings, wire rope cables, any and all other attachments and materials affixed to or from the drilling rig for lifting and/or supporting of any and all types of materials. These overhead cables would be affixed to lifting attachments 15 in lieu of the telescoping support member TS, or may be utilized in conjunction therewith in cases of very inhospitable weather conditions.

In implementing this alternative means of support, a cable is suspended from the rig and affixed to lifting attachments 15 such that the overhead support 0 is suspended above the wellhead o other desired area. Cables affixed to the floor or to the rig structure to the side of the overhead support 0 would then be attached to overhead support 0 so as to provide stability to the suspended system. The sidewall could then be implemented as taught above in its standard manner.

This alternative would be advantageous in situations where it might be undesirable to attach support means to the area to be treated, and provides a working environment with substantially more room, as the telescoping support means would not be used.

A second alternative means of support having similar advantages to the above alternative relates to a heavy duty alternative design for the vertical sidewall support members 45, 31 whereby said sidewall support members are reinforced so as to support the weight of overhead support member 0. With reinforced sidewall support means, telescopic means of support TS would not be necessary. Further, utilizing sidewall support members 45, 31 to support overhead support member would also increase the available space inside the structure.

It is noted that, although the present invention is taught for use in conjunction with the heating and fabrication of wells and wellheads, it is nonetheless submitted that the present invention may be utilized in an unlimited variety of other situations, configurations and applications related and unrelated to the oil field, with similar satisfactory results.

Other uses for the present invention may relate to the construction of buildings, bridges, offshore oil platforms, process piping, pipelines, and any other application involving welding and related and unrelated processes where a totally controlled environment is necessary.

The embodiments described herein in detail for exemplary purposes are of course subject to many different variations in structure, design, application and methodology. Because many varying and different embodiments may be made within the scope of the inventive concept(s) herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A portable wellhead and welder protector system for a wellhead on a well, comprising:

adjustable support means for supporting said wellhead and welder protector, said support means comprising:

a. adjustable connection means for connecting said support means to the wellhead, b. telescoping support means emanating from said adjustable connection means, said telescoping support means adjustably extending the height of said wellhead and welder protector, c. connection means for connecting said telescoping support means to said overhead protection means;

overhead protection means associated with said adjustable support means, said overhead protection means comprising a somewhat flat, horizontal planar surface designed to protect occupants, the wellhead and well from overhead falling objects and liquids;

side wall means associated with said overhead protection means, said side wall means vertically projecting downward around the periphery of said overhead protection means; and ventilation means associated with said overhead protection means for ventilating at least part of the area within said protector to the ambient.

2. The portable wellhead and welder protector of claim 1, wherein said adjustable support means further includes:

a number of laterally spaced, long, vertical telescoping tubing members having means to threadingly engage said adjustable support connection means to the wellhead.

3. The portable wellhead and welder protector of claim 1, wherein said adjustable support connection means of connecting said support means to the wellhead includes:

a multiple number of flange connection assemblies, said assemblies providing means to portably engage said adjustable support means to said wellhead.

4. The portable wellhead and welder protector of claim 1, wherein said adjustable support means further includes:

a plurality of vertically spaced adjustment holes for adjusting the height of said adjustable support means.

5. The portable wellhead and welder protector of claim 1, wherein said connection means for connecting said telescoping support means to said overhead protection means further comprises:

a sliding sleeve in the form of a tubular member configured perpendicular relative to the adjustable support means, said sliding sleeve threadingly attached to the end of the adjustable support means opposite the flange connection assemblies, said sliding sleeve encircling a horizontal tubular member affixed to the underside of said overhead protection means, providing a sliding friction connection with said horizontal tubular member.

6. The portable wellhead and welder protector of claim 1, wherein the wellhead is of the flange type having tap holes, and said adjustable connection means of connecting said support means to the wellhead includes:

a multiple number of flange connection assemblies, said assemblies positioned and configured to pass through the tap holes of the flange type wellhead.

7. The portable wellhead and welder protector of claim 1, wherein the wellhead is of the flange type having tap holes, and wherein said adjustable connection means further includes:

securement means for securing said adjustable connection means to the flange type wellhead, said securement means comprising a lock bolt and washer arrangement threadingly engaging said adjustable connection means portion diverted through the tap hole of the flange type wellhead.

8. The portable wellhead and welder protector of claim 1, wherein said overhead protection means is comprised of sufficient sturdy material, such as aluminum, galvanized sheet metal, thick fabric or the like.

9. The portable wellhead and welder protector of claim 1 wherein said overhead protection means is configured and is sufficiently strong t withstand the impact of overhead falling objects and liquids.

10. The portable wellhead and welder protector of claim 1, wherein said side wall means is comprised of:

a fireproof, windproof, and waterproof material.

11. The portable wellhead and welder protector of claim 1, wherein the well includes a deck floor and said side wall means includes:

structural support means, said structural support means comprising a vertical support member threadingly affixed to the outer periphery of said overhead protection means and running laterally in a vertical manner, terminating at the deck and including means to portably affix said vertical support member to the deck floor.

12. The structural support means of claim 11, wherein said structural support means further includes:

affixing means for affixing said vertical support member to the deck floor in the form of a magnet affixed to the base of said vertical support member.

13. The portable wellhead and welder protector of claim 1, wherein said side wall means further comprises:

affixing means to envelope or otherwise affix said vertical support member to said side wall.

14. The portable wellhead and welder protector of claim 1, wherein said side wall means further includes:

window means, said window means comprising a rectilinear sheet of clear vinyl or the like.

15. The portable wellhead and welder protector of claim 1, wherein the well has a deck and said side wall means further includes:

passage means, said passage means comprising a vertical opening extending from the deck to the periphery of said overhead protection means.

16. The portable wellhead and welder protector of claim 1, wherein said ventilation means comprises a wind driven turbine affixed to said overhead protection means.

17. The potable wellhead and welder protector of claim 1, wherein said ventilation means comprises:

an electric motor driven, thermostatically controlled fan.

18. The portable wellhead and welder protector of claim 1, wherein said adjustable means for connecting said support means to the wellhead includes a clamp positioned perpendicular relative to the wellhead, said clamp providing a friction connection on the inner and outer surface of the wellhead.

19. The portable wellhead and welder protector of claim 1, wherein said wellhead and welder protector further includes:

connection means for connection to the base plate of the wellhead.

20. The portable wellhead and welder protector of claim 1, wherein there is further included floor support means, said floor support means comprising:

a. horizontal support means connected to said adjustable support means, b. vertical support means adjustably connected in a perpendicular manner to said horizontal support means, said vertical support means being connected to said base plate clamp, and c. floor support means intersecting said vertical support means and said vertical support member of said sidewall.

21. The portable wellhead and welder protector of claim 1, wherein said telescopic support means includes the utilization of overhead support in the form of a load bearing member flexible along its length affixed to said overhead support means of the drilling rig for the supporting of various types of materials.

22. The portable wellhead and welder protector of claim 1, wherein said telescopic support means comprises:

vertical support members affixed to the outer periphery of said overhead support means.

23. A method of protecting a wellhead on a well, comprising the following step(s):

(A) implementing a wellhead and welder protector, said wellhead and welder protector comprising:

adjustable support means for supporting said wellhead and welder protector, said support means comprising:

a. adjustable connection means for connecting said support means to the wellhead, b. telescoping support means emanating from said adjustable connection means, said telescoping support means adjustably extending the height of said wellhead and welder protector, as desired.

c. connection means for connecting said telescoping support means to said overhead protection means;

overhead protection means associated with said adjustable support means, said overhead protection means comprising a somewhat flat, horizontal planer surface designed to protect occupants the wellhead and the well of said portable wellhead and welder protector from overhead falling objects and liquids;

side wall means associated with said overhead protection means, said side wall means vertically projecting downward around the periphery of said overhead protection means; and ventilation means associated with said overhead protection means;

(B) installing said wellhead and welder protector in such as manner as to envelope the immediate environment of the wellhead, providing an environment substantially isolated from the weather and outside activities;

(C) working within the wellhead and welder protector such that said wellhead and welder protector envelopes the welder and wellhead, protecting the welder, wellhead and the well from overhead falling objects and insulating said welder and wellhead from the climate outside of the wellhead and welder protector, said work including:

a. preheating the wellhead and casing, b. welding the wellhead and casing, and c. post-heating the wellhead and casing; and (D) utilizing said ventilator to ventilate any noxious or toxic fumes or smoke associated with said work inside of said wellhead and welder protector to the ambient.

24. The method of claim 23, wherein there is included the further step(s) of:

providing a wellhead and welder protector for utilization in conjunction with the texas deck of an jack-up rig, and providing floor support means for said wellhead and welder protector further independently of said texas deck, said floor support means connected to said wellhead and said base plate of said wellhead, providing a fully self contained working environment isolated from interference outside said wellhead and welder protector and said texas deck.

* * * * *